United States Patent [19]

Hwang

[11] Patent Number: 4,810,998

[45] Date of Patent: Mar. 7, 1989

[54] INTERRUPTION DEMONSTRATING AND MULTI-PHASE BURGLAR DETECTING ALARM

[76] Inventor: Shih-Ming Hwang, No. 11, Alley 12, Ln. 7, Ching-Tyan St., Taipei, Taiwan

[21] Appl. No.: 914,678

[22] Filed: Oct. 2, 1986

[51] Int. Cl.[4] ..... G08B 13/00

[52] U.S. Cl. ..... 340/541; 340/522; 340/566; 340/567; 367/93

[58] Field of Search ..... 340/566–567, 340/565, 555, 526, 523, 522, 541; 367/93; 250/342, 349

[56] References Cited

U.S. PATENT DOCUMENTS

| | | | |
|---|---|---|---|
| 4,195,286 | 3/1980 | Galvin | 340/522 X |
| 4,364,030 | 12/1982 | Rossin | 340/555 X |
| 4,523,095 | 6/1985 | Keller-Steinbach | 340/567 X |
| 4,618,854 | 10/1986 | Miyake et al. | 340/567 |
| 4,630,246 | 12/1986 | Fogler | 340/566 X |
| 4,633,234 | 12/1986 | Gagnon | 340/566 |
| 4,660,024 | 4/1987 | McMaster | 340/522 |
| 4,668,941 | 5/1987 | Davenport et al. | 340/566 X |

*Primary Examiner*—Glen R. Swann, III
*Assistant Examiner*—Thomas J. Mullen, Jr.
*Attorney, Agent, or Firm*—Lane & Aitken

[57] ABSTRACT

The interruption demonstrating and multi-phase burglar alarm system is started by signals from 2 or more than 2 detectors amplified and inputted into an interruption demonstrating circuit. By an outside interruption signal, the sensitivity will be properly adjusted. The device also has a multi-phase to detect in single or adjacent multiple areas. The two detectors will be activated within a pre-set period or will not trigger the alarm. The controlling circuit will reset the device in case of any improper or mistaken signals, thereby providing continuous protection and preventing false alarms.

2 Claims, 2 Drawing Sheets

INTERRUPTION DEMONSTRATING AND MULTI-PHASE BURGLAR DETECTING ALARM

BACKGROUND OF THE INVENTION

There are a lot of burglar alarms on the market, but those burglar alarms mostly depend on minute vibrations to detect a door being opened, or on vibration switches on the doors and windows to detect whether they are being opened or broken. Meanwhile, there are also various devices which can detect movements from burglars and provide protection on line by means by ultrasonic detectors, microwave detectors or infrared detectors. These frequently used devices using ultrasonic detectors, microwave detectors or infrared detectors are all designed for detecting moving objects, and so, false alarms may be caused by cats, dogs, flying insects or the movements of curtains. As for vibration switches, they are easily triggered by nonburglar interruption; therefore, they are apt to cause trouble when being used. Devices using ultrasonic detectors, microwave detectors or infrared detectors etc., are often too sensitive in operation and will also sometimes malfunction if they are affected by minute movements from their surroundings. On the other hand, if the devices are under the required sensitivity, they cannot be considered effective. Accordingly, the appropriate sensitivity of burglar alarm devices is truly an important problem.

In protecting one locality or more than one localities, average burglar alarms might be adjusted to the proper distance and equipped with an interruption demonstrator; however, false alarms could still occur. This new invention has installed two identical or different detectors, equipped with a multi-phase detection instrument. The above detectors can detect in one or different localities so that when two detectors detect the movement within a preset period, then the burglar alarm shall be triggered. If the two detectors have detected the signal at different moments, the controlling circuit will automatically reject the triggering signal and reset the detectors. The chance of causing false alarms will be avoided and so, the function of protection provided by the alarm will be greatly enhanced.

SUMMARY OF THE INVENTION

Installed with two or more than two identical or different detectors, this invention is an interruption demonstrating and multi-phase burglar detecting device, which can protect a single place or the places relatively concerned, by means of comparing and evaluating the detection signals from the detectors.

By increasing the sensitivity adjustment, the detecting signal will be inputted into the demonstrating circuit to demonstrate the interruption signal level; and by the appropriate adjustment in sensitivity and by multiphase, two detectors will trigger the alarm if both, in the preset period, detect the signal. If both detectors have not triggered the alarming device in the preset period, the mistaken signal shall be eliminated and the false alarm will have been avoided. High accuracy in detecting is the distinct feature of this device.

Figure 1:
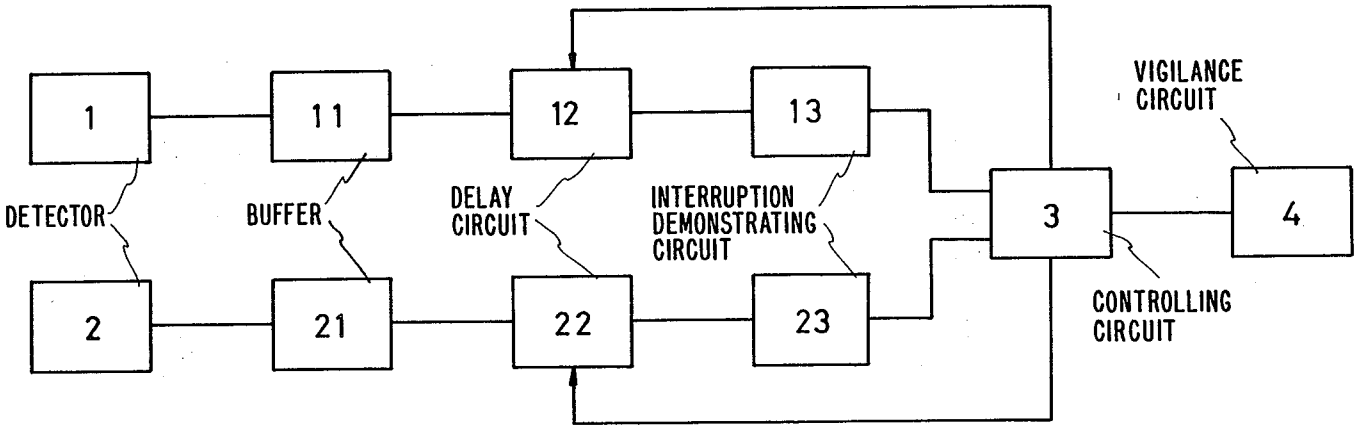
FIG. 1 Operational block diagram of this invention.

DETAILED DESCRIPTION OF THE PREFERRED EMBODIMENT:

FIG. 1 is the operational block diagram of this invention. As shown in FIG. 1, when the detector (1) picks up a signal through the buffer (11) and the delay circuit (12), the signal will be demonstrated on the interruption demonstrating circuit (13). Meanwhile the signal will also be delivered to the controlling circuit (3). As for the second detector (2), when it picks up a signal through the buffer (21) and the delay circuit (22), the second interruption demonstrating circuit will demonstrate the signal, and this signal will also be delivered to the controlling circuit (3). The controlling circuit (3) could reject an incorrect signal from the detectors and reset the detectors to avoid a false alarm on the one hand, or accurately start the vigilance circuit (4) and alarm on the other.

This invention of a burglar alarm could use two different detectors, such as glass break detectors, infrared detectors or ultrasonic detectors, in the same place or two identical burglar alarm detectors in different places. However, in detecting in different places, the detection areas should be adjacent. For instance, the burglar should pass the place detected by the first detector and step into the place detected by the second detector. In this case, this device will be effective in burglar proofing and reducing false alarms.

Figure 2:
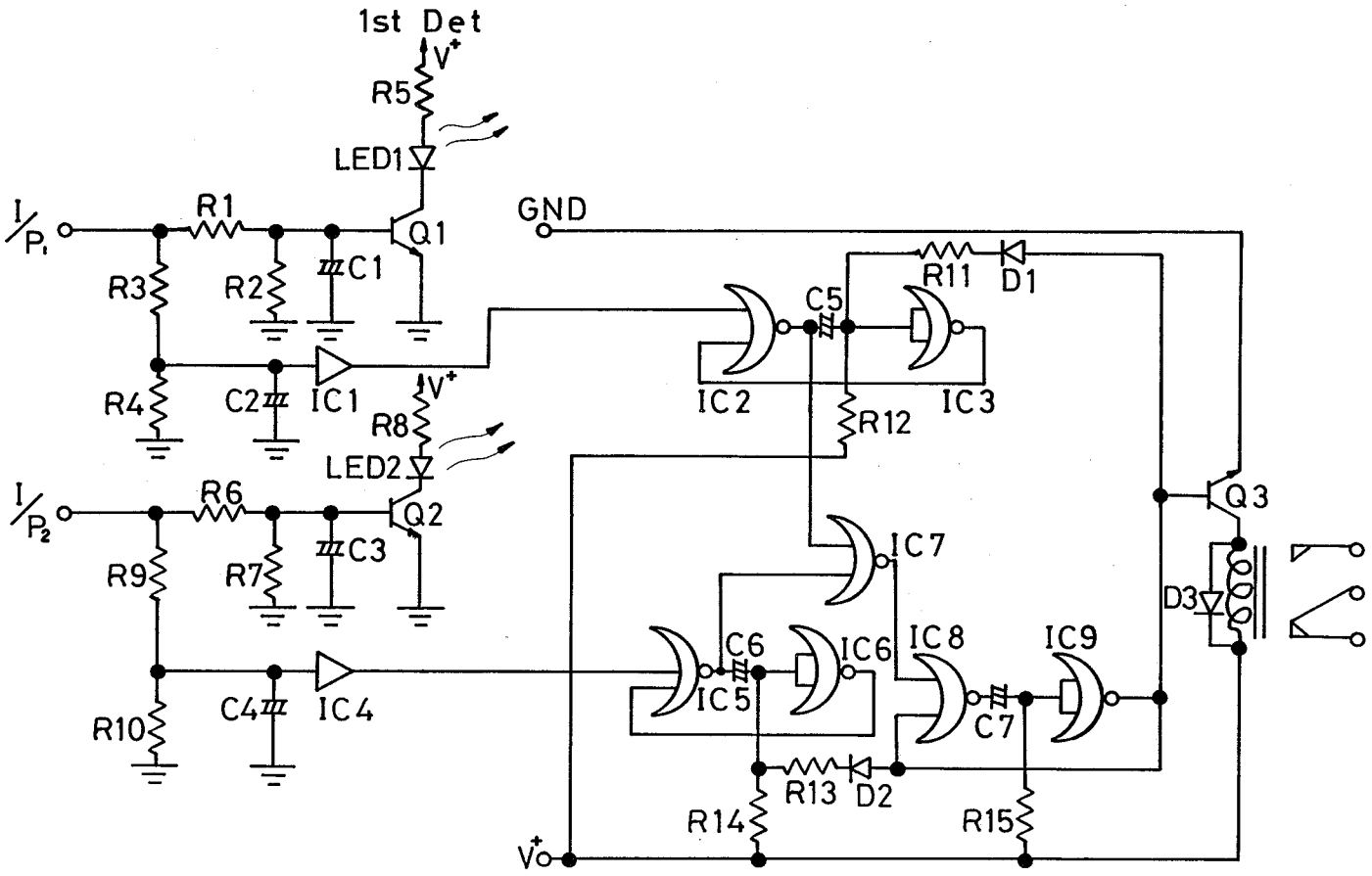
FIG. 2 Operational electric circuit diagram of this invention.

FIG. 2 is the operational electric circuit diagram of this invention. As shown in the diagram, the first burglar detector I/P1 input, through the divider of R1, and R2C1, causes Q1 to light LED1 and adjusts the sensitivity to a setting poing so that false alarms caused by oversensitivity can be avoided, while another loop of I/P1 input, through the divider of R3 and R4C2, goes to IC1, IC2, and then IC3. The second burglar detector I/P2 input, through the divider of R6 and R7C3, causes Q2 to light LED2 and adjusts the sensitivity to a setting point so that false alarms caused by oversensitivity can be avoided, while another loop of I/P2 input, through the divider of R9 and R10C4, goes to IC5. At the moment the first or second burglar detector detects any movement i.e., there is input to I/P1 or I/P2; they detect interference signals from the nearby environment too, and LED1 or LED2 displays the magnitude of the signal. LED1 or LED2 lights whenever the strength of the signal reaches a certain level. In other words, by adjusting sensitivity to a predetermined level to keep LED1 or LED2 off, false alarms caused by oversensitivity can be prevented. When IC1 detects the interruptive signal, IC2 will output "Lo", delayed by R12 C5, the delay buffer circuit being composed of IC2, and IC3. As for the burglar alarm's second detector, which will demonstrate the currentness by interruption, it inputs into IC5 and IC6.

At this moment, IC5 outputs "Lo" and is latched by IC5 and IC6. C6 and R14 are a delay circuit: when the first detector detects the signal and in the period of C5R12, the system also receives the signal from the second detector, they will make IC2 and IC5 to output "Lo" and make IC7 to output "Hi". R15 and C7 are an alarming automatic cut-off circuit; at the time the vigilance circuit has been started, IC7 outputs "Hi" and IC8 outputs "Lo". While "Hi" output by IC9 runs through R11, D1 resets the first burglar alarm detector; on the other hand, it will electrify Q3; then the installment of the controlling vigilance circuit will start the alarm. After the time-counting of R15C7, even though the output of IC9 changed from "Hi" to "Lo", the alarm will be started immediately by D1, R11, D2, and R13, and the detector will also be reset for preparation of a second signal input.

The distinct feature of this device is that the first detector's timing delay C5 R12 shall be overlapped with the second detector's timing delay C6 R14 and that only when both are activated shall the alarm be triggered; otherwise the burglar alarm will not be activated. The goal of this device, to avoid false alarms, can reached by means of two time-overlapping detectors.

There are no less than two detectors in this invention, but the number of detectors can be increased as necessary.

I claim:

1. A burglar alarm system comprising a first motion detecting means operable to detect motion in a first determined locality and generate a first signal in response thereto, a second motion detecting means to detect motion in a second predetermined locality different from and adjacent to said first locality and generate a second signal in response thereto, and means responsive to the simultaneous occurrence of said first and second signals or the occurrence of said first and second signals at different times with no overlap and within a predetermined time interval to energize an alarm.

2. A burglar alarm system as recited in claim 1, further comprising means to adjust the sensitivity of said first motion detecting means, means to visually demonstrate when the signal level of said first signal exceeds a predetermined threshold, means to adjust the sensitivity of said second motion detecting means, and means to visually demonstrate when the level of said second signal exceeds a predetermined threshold.

* * * * *